United States Patent [19]

Gelaude

[11] 4,428,434

[45] Jan. 31, 1984

[54] AUTOMATIC FIRE PROTECTION SYSTEM

[76] Inventor: Jonathon L. Gelaude, 15708 Mayall St., Granada Hills, Calif. 91344

[21] Appl. No.: 275,264

[22] Filed: Jun. 19, 1981

[51] Int. Cl.[3] ..... A62C 35/00

[52] U.S. Cl. ..... 169/13; 239/70; 137/624.11

[58] Field of Search ..... 169/54, 56, 60, 61, 169/13, 16; 239/66, 67, 69, 70, 208; 340/309.1, 309.4, 584; 137/624.11

[56] References Cited

U.S. PATENT DOCUMENTS

| | | | |
|---|---|---|---|
| 3,179,181 | 4/1965 | Banzato | 169/13 |
| 3,234,956 | 2/1966 | Stickle | 137/624.11 |
| 3,583,490 | 6/1971 | McFadden | 169/54 |
| 3,750,161 | 7/1973 | Teeters | 169/61 |
| 3,889,881 | 6/1975 | Cunningham et al. | 239/70 |
| 3,993,138 | 11/1976 | Stevens et al. | 169/61 |

*Primary Examiner*—Joseph J. Rolla
*Assistant Examiner*—Kenneth Noland
*Attorney, Agent, or Firm*—Sanford Astor

[57] ABSTRACT

This invention relates to an automatic system for protecting a home or other buildings from fire damage comprising automatic temperature sensors to monitor the temperature of several places on the structure, sensor amplifiers to amplify the signal from the temperature sensors, an anticipating function for turning on the system in response to a predetermined temperature or a sudden rise in temperature, a timer function which turns on the flow rate of water from a nearby water source, a multiple flow rate control system to provide both high and low rate of water, a switch to manually lock the system into the high flow rate, an audible alarm system, and a circuit for testing and manually starting the system.

6 Claims, 2 Drawing Figures

AUTOMATIC FIRE PROTECTION SYSTEM

BACKGROUND OF THE INVENTION

Each year many buildings, both residential and commercial, are destroyed by fires. These fires may be of the brush or forest fire type in residential areas or industrial fires that occur in various plants. Very often the structures involved could be saved if an automatic sensoring system, together with a nearby supply of water were available to wet the structure down in sufficient time to prevent the structure from being set afire by small cinders or small localized fires. While most commercial and industrial buildings are now being built with water sprinkler systems, many older commercial and industrial buildings and most all residences do not have these sprinkler systems. In addition, even those buildings that do have sprinkling systems are subject to the system being useless when the local water supply through the city water supply system is lacking.

OBJECTS OF THE INVENTION

It is the object of the present invention to provide a fire protecting system for structures utilizing available nearby water supply which douses the structure at automatic response to the presence of fire.

Yet a further object of the invention is to provide a totally automatic fire protection system for residences and other commercial and industrial buildings.

Yet another object of the invention is to provide an automatic fire protection system for residences and other buildings, which contain sufficient electronic controls to adequately control the response of the system.

While some structure fire protecting systems have been known in the prior art, these systems fail completely to provide adequate controls on the operation of the system to be actually practical.

DESCRIPTION OF THE INVENTION

Figure 1:
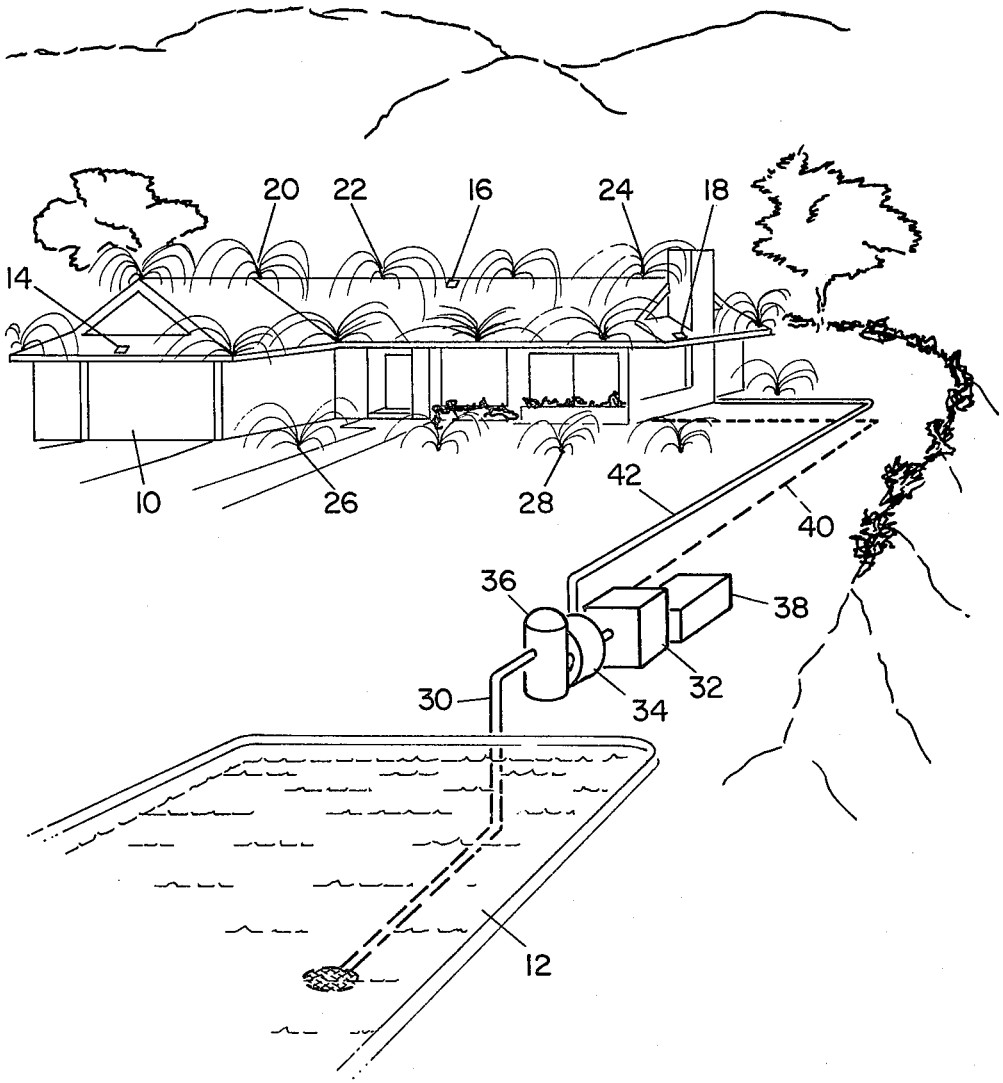
Figure 2:
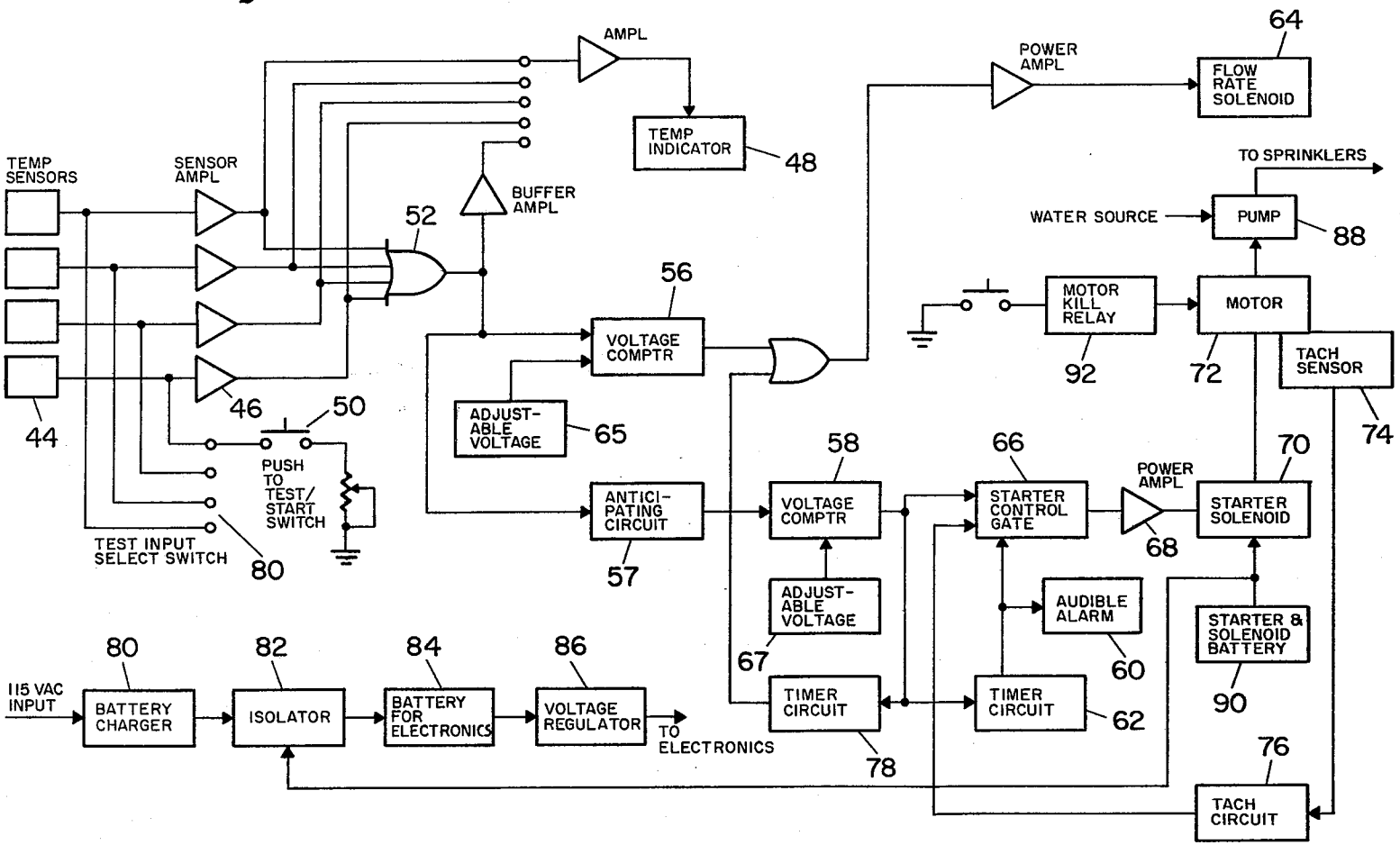

These and other objects of the invention and advantages will become apparent from the following detailed description when taken in conjunction with the accompanying drawings in which FIG. 1 is a diagrammatic view showing the fire protection system of the present invention; and FIG. 2 is a flow diagram showing the electronic controls of the present system.

Referring now to the drawings, there is shown in FIG. 1 a residential house 10, having a nearby source of water which is the swimming pool adjacent to the house 12. A plurality of temperature sensors, such as 14, 16 and 18, are placed on the structure to monitor the temperature of a plurality of locations on the structure itself. These sensors comprise two types, one sensor is a direct air temperature sensor. This type of sensor reads the actual air temperature that is present and can be set so that the watering system is turned on when a given temperature is recorded. The system is also set up to turn on the watering system when a sudden or rapid increase in temperature is read by the sensors even though the temperature fails to reach the air temperature response of the first sensors. A second type of sensor is also present. This type of sensor reacts to radiant heat in order to detect a fire at some distance.

A plurality of sprinkler heads, such as 20, 22 and 24 are placed on the structure to direct water when the system is turned on across the entire structure. The system may also be set up so that nearby sprinklers set into the ground or lawn, such as 26 and 28, are also turned on at the time the system is turned on, in order to water down the base of the structure and the ground near to the structure.

A piping system 30 extends into the swimming pool or other available water source to obtain the water from the pool or if the system is built at the time the pool is built the piping structure can be placed underneath the pool. A power source 32 is connected to a pump comprising the pump body 34 and the pump strainer 36. The electronics which will be explained more in FIG. 2 are contained in box 38 which may also be placed at another location such as in the garage. Lines 40 leading from the sensors to the operational unit carry the signal from the sensors on the house. Water line 42 carries the water from the water source through the pump to the sprinklers on the house and grounds when the system is activated.

Referring now to FIG. 2, there is shown a flow diagram showing each of the elements of the present invention. A plurality of temperature sensors 44 are located at various locations on the structure involved. Temperature sensors are connected to sensor amplifiers 46 to amplify the signal to be carried to the controlling circuit. A visual temperature indicator 48 is provided so that if a person is present he may at all times read the temperature of the hottest temperature sensor that exists on the building or structure. Temperature indicator 48 is adapted so that the output of each sensor may be read individually, or the output of all sensors may be combined and the hottest one indicated.

A test circuit 50 is provided so that the system may be tested at any time desired.

An "OR" gate 52, the output of which is proportional to the temperature of the hottest sensor allows the temperature meter to monitor the hottest area.

An anticipating circuit 54 comprises a differentiating amplifier. The output of this circuit is proportional not only to the level of the input but also the rate of change of the input so that a rapid rise in temperature causes the output to swing to a level equivalent to one higher than the actual temperature. When the output of the anticipating circuit exceeds the voltage on the negative input of the comparator 56, the output of the comparator switches from low to high initiating the audible alarm 60 and the timer circuit 62. This also activates the flow rate solenoid 64. The adjustable voltage 65 and 67 allows the user to regulate the trip temperature of the comparators 56 and 58.

The timer function turns on a high flow rate solenoid for a selected length of time in order to wet down the premises quickly. After the selected time period, the flow rate is reduced to a level calculated to keep the premises wet.

When the alarm timer 62 is initiated its output goes from high to low, turning on the alarm 60, and also allowing the starter control gate 66, power amplifier 68, and starter solenoid 70 to energize the starter motor 72 of the engine. A tachometer 74 and tachometer circuit 76 mounted on the motor shaft supplies a signal so that when the motor comes up to normal running speed the starter motor is automatically de-energized.

When the motor 72 is started, a timing circuit 78 is initiated. This timing circuit 78 energizes the high flow rate solenoid. When the timer output goes low, the solenoid is deenergized and the normal flow rate which is a reduced flow rate is maintained. If at any time the sensor output of the "OR" gate 52 goes lower than the voltage at the positive input of the comparator circuit 56, the high flow rate solenoid is again turned on. The test input select switch 80 can be grounded through a variable resistor which can simulate a hot sensor and should initiate the alarm and start sequences. The variable resistor can be adjusted to simulate various temperatures for calibration purposes.

A battery charger 80, isolator 82, the battery for the electronics 84, and a voltage regulator 86 are provided to operate the electronics of this system. The motor 72 operates pump 88 which pumps the water from the water source to the sprinklers on the structure. A starter and solenoid battery 90 provides the power to the starter solenoid 70.

A switch is also provided to manually lock the system into the high flow rate if desired by a person who is present.

The audible alarm 60 sounds for a pre-selected time, during which the starting circuit is inhibited. This slight delay time allows any person who is present to stop the operation of the system by a motor kill relay 92, in case the system is being initiated falsely. A manual start, in addition to the automatic control system, is also provided so that a person can turn the system on, if desired, without response to the automatic temperature sensors.

Two types of temperature sensors are utilized in the present invention, direct air temperature sensors which read the temperature of the air as well as radiant heat sensors which pick up sudden increases in temperature and make the system responsive to such sudden increases. The radiant temperature sensors are shielded to prevent picking up improper responses, such as glare off of a nearby window.

An average swimming pool adjacent to a residential structure contains 50 to 60,000 gallons of water. This is sufficient water to run the system of the present invention for 12 to 15 hours, which is usually more than enough to protect the structure from a possible fire damage.

In many instances, when forest fires are nearby practically every person in a given neighborhood will be on the roof hosing down his structure. If a very large number of people do this in any given area, there will be a total lack of water pressure available from the public water supply. The system of the present invention utilizes a large volume of water which is very often available nearby to the structure, without the necessity of worrying about the water supply from the public system.

Various modifications and changes may be made with respect to the foregoing detailed description, without departing from the spirit of the present invention or the scope of the following claims.

I claim:

1. An automatic fire protection system for a structure comprising: sprinkler means on said structure, a water supply for said sprinkler means, pump means for pumping water from said water supply to said sprinkler means, power means to operate said pump means, automatic temperature sensors affixed to said structure, anticipating electronic means adapted to initiate the power means in response to any of the following occurrences, a predetermined temperature being sensed by the automatic temperature sensors, a predetermined rapid rise in temperature wherein the rate of change of temperature initiates the power means or a radiant heat reading, a timer function adapted to turn on the pump means, the anticipating means comprising a differentiating amplifier whose output is proportional not only to the level of input but also the rate of change of the input, so that a rapid rise of temperature causes the output of the differentiating amplifier to swing to a level equivalent to one higher than the actual temperature which will initiate the power means if the preselected level is reached.

2. The system of claim 1 comprising a manual override system, an audible alarm and a circuit for testing and manually starting the system.

3. The system of claim 1 comprising sprinkler means located on the ground near said structure.

4. The system of claim 1 comprising a timer function which turns on the high flow rate for a preselected time and then automatically reduces the flow rate of water.

5. The system of claim 1 in which the anticipating electronic means is adapted to change the flow rate of water from low flow back to high flow upon sensing the preselected temperature, rate of change of temperature or radiant heat reading.

6. An automatic fire protection system for a structure comprising: sprinkler means on said structure, a water supply for said spinkler means, pump means for pumping water from said water supply to said sprinkler means, power means to operate said pump means, automatic temperature sensors affixed to said structure, anticipating electronic means adapted to initiate the power means in response to any of the following occurrences: a predetermined temperature being sensed by the automatic temperature sensors, a predetermined rapid rise in temperature wherein the rate of change of temperature initiates the power means, or a radiant heat reading, wherein the anticipating electronic means comprises a differentiating amplifier whose output is proportional not only to the level of input so that a rapid rise of temperature causes the output of the differentiating amplifier to swing to a level equivalent to one higher than the actual temperature which will initiate the power means if the preselected level is reached, a timer function which turns on a high flow rate of water for a preselected time and automatically reduces the flow rate of water, and in which the anticipating electronic means is adapted to change the flow rate of water from a low flow back to the high flow upon sensing the preselected temperature, rate of change of temperature or radiant heat reading.

* * * * *